US005551846A

United States Patent [19]

Taylor et al.

[11] Patent Number: 5,551,846

[45] Date of Patent: Sep. 3, 1996

[54] SCROLL COMPRESSOR CAPACITY CONTROL VALVE

[75] Inventors: Roderick D. Taylor, Dearborn; Brian R. Kelm, Northville, both of Mich.

[73] Assignee: Ford Motor Company, Dearborn, Mich.

[21] Appl. No.: 566,202

[22] Filed: Dec. 1, 1995

[51] Int. Cl.[6] ..... F04C 18/02

[52] U.S. Cl. ..... 417/308; 417/310; 417/440; 418/55.1

[58] Field of Search ..... 417/308, 310, 417/440; 418/55.1

[56] References Cited

U.S. PATENT DOCUMENTS

| | | | |
|---|---|---|---|
| 2,265,444 | 12/1941 | Morrison et al. | 18/270 |
| 3,628,893 | 12/1971 | Carpigiani | 417/310 |
| 4,656,710 | 4/1987 | Maciejewski | 29/156.4 WL |
| 4,717,314 | 1/1988 | Sato et al. | 417/310 |
| 4,904,164 | 2/1990 | Mabe et al. | 417/308 |
| 5,356,271 | 10/1994 | Miura et al. | 417/310 |
| 5,451,146 | 9/1995 | Inagaki et al. | 417/308 X |

FOREIGN PATENT DOCUMENTS

| | | |
|---|---|---|
| 3-237285 | 10/1991 | Japan . |
| 4-76290 | 3/1992 | Japan . |
| 4-187892 | 7/1992 | Japan . |
| 4-191488 | 7/1992 | Japan . |
| 5-223072 | 8/1993 | Japan . |

*Primary Examiner*—Richard E. Gluck

*Attorney, Agent, or Firm*—Roger L. May; Raymond L. Coppiellie

[57] ABSTRACT

A scroll compressor has a housing, fixed and movable scrolls mounted in the housing, and a control valve. The fixed scroll has a discharge port and pairs of bypass ports located at thermodynamically symmetrical points in the compression cycle relative to said discharge port The moving scroll is mounted in the housing and intermeshed with the fixed scroll to trap a volume of fluid. A rotatable, cylindrical control valve has pairs of slots therein that are alignable with the pairs of bypass ports to sequentially vent the trapped fluid and modulate the capacity of the compressor. The valve controls the pumping capacity of the scroll compressor by placing a series of bypass ports across the base of the fixed scroll. The bypass ports allow gas to flow from the compression chambers via the control valve to the low pressure chamber. The flow and sequencing of the ports is controlled by rotating the valve crossing over the ports. As the bypass ports are uncovered, the partially compressed gas from the working chamber is vented to the low pressure chamber reducing the output of the pump. By opening several sets of ports progressively from early stages of compression to final compression, the compressor capacity is reduced with minimum waste work.

11 Claims, 1 Drawing Sheet

SCROLL COMPRESSOR CAPACITY CONTROL VALVE

FIELD OF THE INVENTION

The present invention relates generally to scroll compressors, and, more particularly, to a control valve for varying the output of a scroll compressor.

BACKGROUND OF THE INVENTION

Scroll compressors of small sizes are today used for air conditioning and refrigeration applications, such as the air conditioning system of a vehicle. The attraction of a scroll compressor is it has relatively few moving parts, is highly reliable, offers positive displacement, high efficiencies, and low noise levels. The primary components of a scroll compressor are a stationary scroll and a moving scroll, one of which is rotated by 180° and meshed with the other. The moving scroll is mounted on an eccentric crank so that rotation of the drive produces an orbital motion of the scroll body; however, the scroll does not rotate because it is constrained by a device that ensures the scroll remains in the same angular position during the orbiting motion. As the moving scroll orbits, gas is drawn into and trapped within the two scrolls. The gas moves steadily toward the center of the scrolls and the volume of the gas is reduced as the gas moves toward the center of the scrolls where there is a discharge port through the stationary scroll that allows the gas to discharge. A compressor has a built in swept volume and unswept (clearance) volume; the ratio of the two has a direct affect on performance and efficiency of the compressor. The discharge and bypass ports are a major portion of the unswept volume. The larger the unswept volume, the lower the amount of compression there is before the gas is released; conversely, the smaller the unswept volume, the higher the compression before the gas is released. The gas is drawn in, trapped, reduced in volume, and finally open to the discharge port where it is expelled.

Several methods of capacity control are possible with a scroll compressor including speed variation, suction throttling and internal recirculation. While speed variation is an excellent method of capacity control, it typically uses a frequency inverter to provide a wide range of speeds from a standard ac motor which is not practical for automotive applications. In automotive applications, suction throttling is possible, but is limited by temperature rise due to the increasing pressure ratio. Some screw compressors for refrigeration/gas use an integral slide valve in larger sizes and lift valves in the smaller sizes for off loading. These valves release some of the gas that has been drawn in and trapped just before the internal compression has put energy into it. Thus, the off loading achieved is efficient, as very little energy has gone into the gas returned to the compression suction. The same concept can be built into a scroll compressor. Unfortunately, in the small sized compressors used for automotive applications, the complexity involved makes the compressors relatively expensive, and therefore undesirable. Accordingly, it will be appreciated that it would be highly desirable to have simple device for controlling volume in a scroll compressor for automotive use.

In automotive applications, it is desirable to use a single component for several different vehicle models wherein each model has unique cooling requirements. In using a single component, such as a scroll compressor in an air conditioning system, the compressor output needs to be varied to meet the unique requirements and achieve maximum energy efficiency. In the past, complex valving systems were used with the desired results, but at the cost of increased complexity parts count. Increasing the parts count is undesirable because each part is a potential trouble source. Therefore, it will be appreciated that it would be highly desirable to vary the output of a scroll compressor using a minimum number of components.

SUMMARY OF THE INVENTION

The present invention is directed to overcoming one or more of the problems set forth above. Briefly summarized, according to one aspect of the present invention, a scroll compressor having a fluid capacity and a compression cycle comprises a housing, a fixed scroll, a movable scroll and a control valve. The fixed scroll is mounted in the housing and has a central discharge port, and a first pair of bypass ports located at thermodynamically symmetrical points in said compression cycle relative to said discharge port. The moving scroll is mounted in the housing and intermeshed with the fixed scroll to trap a volume of fluid between the fixed and moving scrolls. The rotatable, hollow, cylindrical control valve has a valve wall with a first pair of slots therein controllably alignable with the pair of bypass ports to vent the trapped fluid and modulate the fluid capacity of the scroll compressor.

According to another aspect of the invention, a valve for modulating fluid capacity of a scroll compressor, wherein the compressor has a fixed scroll with a first pair of bypass vents and a discharge port therein, and a movable scroll, comprises a rotatable, hollow, cylindrical valve wall with a first pair of slots in the valve wall controllably alignable with the pair of bypass ports to vent fluid and modulate the volume of fluid with the valve having open ends providing a passageway for vented fluid.

The control valve has end portions of equal diametrical dimension and a middle portion intermediate the end portions of lesser diametrical dimension than the end portions so that the middle portion and the fixed scroll form a passageway for fluid exiting the discharge port. The fixed scroll has a second pair of bypass ports positioned inboard of the first pair of bypass ports and the valve wall has a second pair of slots controllably alignable with the second pair of bypass ports to vent the fluid and thereby modulate volumetric capacity of the compressor.

The cylindrical rotatable valve controls the pumping capacity of the scroll compressor. Control is achieved by placing a series of bypass ports across the base of the fixed scroll. The ports allow gas to flow from the compression chambers via the control valve to the low pressure chamber. The flow and sequencing of the ports is controlled by rotating the valve crossing over the ports. As the bypass ports are uncovered, the partially compressed gas from the working chamber is vented to the low pressure chamber reducing the output of the pump. By opening several sets of ports progressively from early stages of compression to final compression, the compressor capacity is reduced with minimum waste work.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
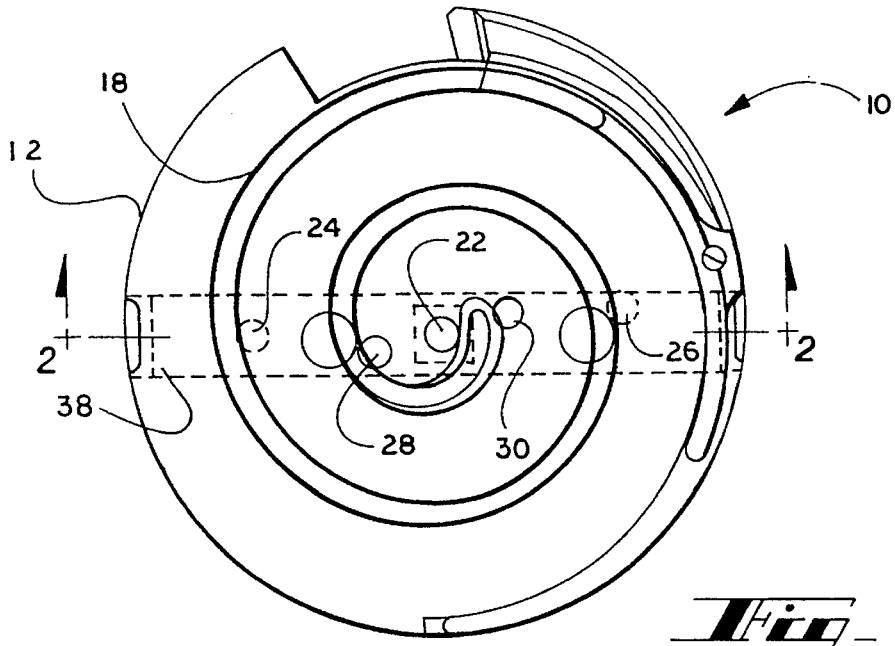
FIG. 1 is a diagrammatic plan view of a preferred embodiment of a stationary scroll of a scroll compressor incorporating a rotary control valve according to the present invention.
Figure 2:
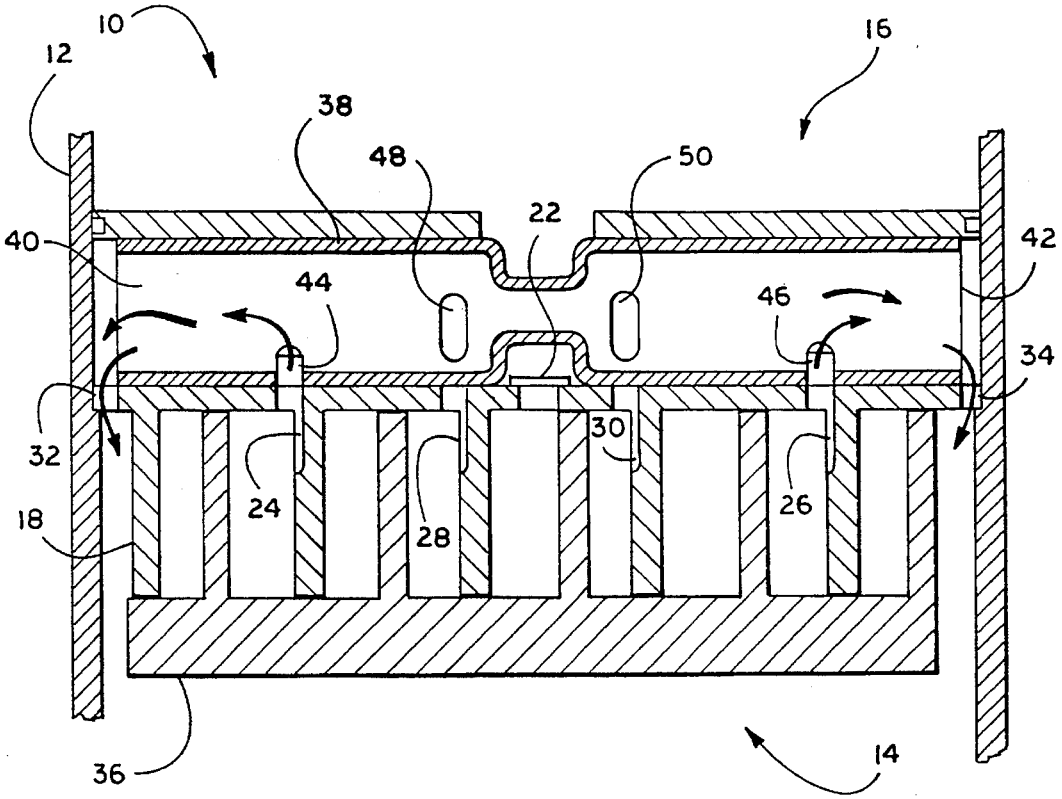
FIG. 2 is a diagrammatic sectional view of a scroll compressor as taken along line 2—2 of Figure but also illustrating a moving scroll.

Referring to FIGS. 1–2, a scroll compressor 10 has a sealed housing 12 with an inlet and an outlet (not shown) connecting the compressor 10 to an air conditioning system of a vehicle, for example. The inlet admits gas to the low pressure chamber 14 and the outlet delivers gas from the high pressure chamber 16 of the housing to the air conditioning system.

A fixed scroll 18 is mounted in the housing 12 and has a discharge port 22 that discharges compressed refrigerant gas to the high pressure chamber 16 of the housing 12. The fixed scroll 18 has a first pair of bypass ports 24, 26 that are spaced from the discharge port 22 and positioned about the discharge port 22 at thermodynamically symmetric locations; that is, at points of equal pressure and temperature. Thermodynamically symmetric locations can be determined by calculation or measurement. There may be a second pair of bypass ports 28, 30 positioned inboard of the first pair of bypass ports 24, 26, and there may be other pairs of bypass ports. As illustrated, bypass ports 24 and 28 are located to the left of the discharge port 22, while bypass ports 26 and 30 are located to the right of the discharge port 22.

A first vent 32 is formed in the fixed scroll 18 adjacent the left wall of the housing 12, and a second vent 34 is located to the right of the discharge port 22 adjacent the rit wall of the housing 12. The vents 32, 34 provide a passageway to the low pressure chamber 14 in the housing 12.

A moving scroll 36 is also mounted in the housing 12 and intermeshed with the fixed scroll 18 to trap the working gas between the two scrolls for compression.

A hollow cylindrical control valve 38 is mounted in the housing 12 adjacent the fixed scroll 18. The cylindrical valve 38 has an open left end 40 in communication with the low pressure chamber 14 via the left vent 32, and has an open right end 42 in communication with the low pressure chamber 14 via the fight vent 34. The valve wall has a first pair of slots 44, 46 that are controllably alignable with the first pair of bypass ports 24, 26, and has a second pair of slots 48, 50 that are controllably alignable with the second pair of bypass ports 28, 30. When the slots and vents are aligned, gas can be vented through the open ends of the valve through the left and right vents to the low pressure chamber. Venting gas modulates the capacity of the compressor and varies the volume for differing applications. A primary result of rotating the valve to the minimum capacity point is recirculating the refrigerant during minimum compression. A benefit of the rotary valve is that when the valve is set in the maximum capacity position wherein the bypass ports are all closed, the unswept volume resulting from the mechanism is much smaller because the rotary valve is close to the working surface. This results in improved performance and higher efficiency.

The valve 38 has left and right end portions of equal diametrical dimension and has a middle portion intermediate the end portions that is of lesser diametrical dimension that the end portions. The reduced diameter middle portion and the fixed scroll form a passageway in the area of the discharge port for gas exiting the discharge port on its way to the high pressure chamber. Alternatively, the middle portion of the valve may have the same diameter as the end portions, in which event, the discharge port would be offset so that the valve dose not block the discharge port.

Operation of the present invention is believed to be apparent from the foregoing description and drawings, but a few words will be added for emphasis. The rotary control valve may be operated by a control piston connected to the valve by a connecting rod drive or may be operated by a rack drive or electric motor. The rotary valve is rotated to a new position when the system load changes. At high system load, it will be rotated to the maximum capacity position wherein all bypass ports are closed. When the system load reduces, the valve will be rotated such that the bypass ports are open sufficiently to reduce the pump capacity to equal the system load. The valve is moved only when the system load changes. The valve does not need to be moved in synchronism with the moving scroll. The valve need only rotate through an angle sufficient to go from all bypass ports open to all bypass ports closed. While the angle will be a function of the size and configuration of the ports, an angle of about 90° to 150° should be sufficient.

Opening of the bypass ports creates minimum effective swept volume and minimizes waste work of the compressor. As illustrated, the working gas begins its journey toward the discharge port by entering from the left and right ends between the fixed and movable scrolls. As the gas works its way toward the center, the first pair of bypass ports is opened to reduce the effective swept volume as desired, and further compression takes place as the gas moves closer towards the center. Where there are additional bypass port, they are sequentially opened to again reduce the effective swept volume. A bypass port is opened when the corresponding slot in the valve is aligned with the port to provide a passageway for the recirculated gas through the port and the slot out the open end of the cylindrical valve and through a vent into the low pressure chamber as indicated by arrows in FIG. 2.

It can now be appreciated that there has been presented a control valve for modulating the output of a scroll compressor. The compressor has a fixed scroll containing a first pair of bypass ports and a discharge port, and a movable scroll. The valve is a rotatable and hollow with a cylindrical valve wall. A first pair of slots in the valve wall are controllably alignable with the pair of bypass ports to vent fluid and modulate the volume of fluid being compressed. The valve has open ends providing a passageway for vented fluid. The control valve has end portions of equal diametrical dimension and a middle portion intermediate the end portions of lesser diametrical dimension than the end portions so that the middle portion and the fixed scroll form a passageway for fluid exiting the discharge port. The fixed scroll has a second pair of bypass ports positioned inboard of the first pair of bypass ports and the valve wall has a second pair of slots controllably alignable with the second pair of bypass ports to sequentially vent the fluid and thereby modulate volumetric capacity of the compressor.

The cylindrical rotatable valve controls the pumping capacity of the scroll compressor. Control is achieved by placing a series of bypass ports across the base of the fixed scroll. The ports allow gas to flow from the compression chambers via the control valve to the low pressure chamber. The flow and sequencing of the ports is controlled by rotating the valve crossing over the ports. As the bypass ports are uncovered, the partially compressed gas from the working chamber is vented to the low pressure chamber reducing the output of the pump. By opening several sets of ports progressively from early stages of compression to final compression, the compressor capacity is reduced with minimum waste work. The bypass ports may lie on a single axis if that is where thermodyamic equilibrium exists. The positions of the bypass ports are determined by studying the compression cycle and placing pairs of bypass ports thermodynamically symmetrical in the compression cycle at points of equal pressure and temperature.

The tubular rotary control valve is positioned close to the working surface of the fixed scroll to modulate the capacity of the compressor when the valve slots and bypass ports intersect to vent refrigerant. The bypass ports must intersect the rotary valve in order to connect with the slots in the valve. The rotary control valve eliminates clutch cycling. Multiple pairs of bypass ports can be controlled using a single valve assembly thereby minimizing the parts count. The bypass ports create less unswept volume to thereby increase efficiency. The rotary valve can sequence the opening of bypass ports effectively switching off later and later stages of compression which results in less waste work.

While the invention has been described with particular reference to an air conditioning system of a vehicle, it is apparent that the scroll compressor incorporating a rotary control valve is easily adapted to other air conditioning and refrigeration systems. As is evident from the foregoing description, certain aspects of the invention are not limited to the particular details of the examples illustrated, and it is therefore contemplated that other modifications and applications will occur to those skilled in the art. For example, there are other methods of rotating the control valve than those referred to above. Also, a solid member with slots along its exterior for venting the gas could be substituted for the hollow control valve. It is accordingly intended that the claims shall cover all such modifications and applications as do not depart from the true spirit and scope of the invention.

What is claimed is:

1. A scroll compressor having a fluid capacity and a compression cycle, comprising:

a housing;

a fixed scroll mounted in said housing and having a central discharge port and a first pair of bypass ports, said pair of bypass ports being located at thermodynamically symmetrical points in said compression cycle relative to said discharge port;

a moving scroll mounted in said housing and intermeshed with said fixed scroll to trap a fluid between said fixed and moving scrolls; and a rotatable, hollow, cylindrical control valve having a valve wall with a first pair of slots therein controllably alignable with said pair of bypass ports to vent said trapped fluid and modulate said fluid capacity of said scroll compressor.

2. A scroll compressor, as set forth in claim 1, wherein said control valve has first and second end portions of equal diametrical dimension and a middle portion intermediate said first and second end portions of lesser diametrical dimension than said first and second end portions, said middle portion and said fixed scroll forming a passageway for fluid exiting said discharge port.

3. A scroll compressor, as set forth in claim 1, including:

a second pair of bypass ports positioned inboard of said first pair of bypass ports; and a second pair of slots in said valve wall controllably alignable with said second pair of bypass ports to vent said trapped fluid and modulate said fluid capacity of said scroll compressor.

4. A scroll compressor, as set forth in claim 1, including:

a low pressure chamber in said housing, said hollow, cylindrical control valve having open ends providing a passageway for vented fluid to travel to said low pressure chamber.

5. A valve for a scroll compressor, said scroll compressor having a housing, a compression cycle, a fixed scroll mounted in the housing, a first pair of bypass ports located at thermodynamically symmetrical points in said compression cycle, and a central discharge port; and a moving scroll mounted in said housing and intermeshed with said fixed scroll to trap a volume fluid between said fixed and moving scrolls, said valve comprising:

a rotatable, hollow, cylindrical valve wall with a first pair of slots therein controllably alignable with said pair of bypass ports to vent said trapped fluid and modulate said volume of fluid.

6. A scroll compressor, as set forth in claim 5, wherein said control valve has first and second end portions of equal diametrical dimension and a middle portion intermediate said first and second end portions of lesser diametrical dimension than said first and second end portions, said middle portion and said fixed scroll forming a passageway for fluid exiting said discharge port.

7. A scroll compressor, as set forth in claim 5, wherein said fixed scroll has a second pair of bypass ports positioned inboard of said first pair of bypass ports and including a second pair of slots in said valve wall controllably alignable with said second pair of bypass ports to vent said trapped fluid and modulate said volume of fluid.

8. A scroll compressor, as set forth in claim 5, wherein said housing includes a low pressure chamber and said hollow, cylindrical control valve has open ends providing a passageway for vented fluid to travel to said low pressure chamber.

9. A valve for modulating fluid capacity of a scroll compressor, said compressor having a fixed scroll with a first pair of bypass vents and a discharge port therein, and a movable scroll, said valve comprising:

a rotatable, hollow, cylindrical valve wall with a first pair of slots in said valve wall controllably alignable with said pair of bypass ports to vent fluid and modulate said volume of fluid, said valve having open ends providing a passageway for vented fluid.

10. A scroll compressor, as set forth in claim 9, wherein said control valve has first and second end portions of equal diametrical dimension and a middle portion intermediate said first and second end portions of lesser diametrical dimension than said first and second end portions, said middle portion and said fixed scroll forming a passageway for fluid exiting said discharge port.

11. A scroll compressor, as set forth in claim 9, wherein said fixed scroll has a second pair of bypass ports positioned inboard of said first pair of bypass ports and wherein said valve wall has a second pair of slots in said valve wall controllably alignable with said second pair of bypass ports to vent said fluid and thereby modulate volumetric capacity of said compressor.

* * * * *